United States Patent [19]

Diedrich et al.

[11] Patent Number: 4,510,634

[45] Date of Patent: Apr. 16, 1985

[54] INFANT CARRIER

[76] Inventors: Brian J. Diedrich, 10570 E. Oakwood Dr., Tucson, Ariz. 85715; Leslie G. Wolf, II, 1967 W. Riverview, Tucson, Ariz. 85745

[21] Appl. No.: 537,502

[22] Filed: Sep. 30, 1983

[51] Int. Cl.[3] ..... A47C 29/00; A47D 7/00

[52] U.S. Cl. ..... 5/98 B; 5/94; 5/101; 5/405; 297/441; 297/216; 297/464

[58] Field of Search ..... 5/82 R, 94, 98 B, 98 C, 5/101, 403, 405, 431; 297/216, 441, 464, 457; 160/DIG. 15, 402; 224/158; 294/140

[56] References Cited

U.S. PATENT DOCUMENTS

| | | | |
|---|---|---|---|
| Re. 26,490 | 11/1968 | Jensen | 297/377 |
| D. 194,234 | 12/1962 | Ross | D15/100 |
| 1,111,927 | 9/1914 | Stanion | 5/98 B |
| 1,453,942 | 5/1923 | Mills | 5/101 |
| 2,629,432 | 2/1953 | Hanslick | 160/DIG. 15 |
| 2,731,072 | 1/1956 | Post | 155/38 |
| 3,006,688 | 10/1961 | Quellette | 297/457 |
| 3,142,880 | 8/1964 | Davies | 160/DIG. 15 |
| 3,206,247 | 9/1965 | Johnson | 297/254 |
| 3,235,306 | 2/1966 | Chernivsky | 297/296 |
| 3,272,556 | 9/1966 | Rocker | 297/310 |
| 3,290,092 | 12/1966 | Howard | 297/377 |
| 3,529,860 | 9/1970 | Jelley | 160/402 |
| 3,538,522 | 11/1970 | Adams | 5/327 |
| 3,596,986 | 8/1971 | Ragsdale | 297/183 |
| 3,858,936 | 1/1975 | Gerken | 297/377 |
| 4,295,683 | 10/1981 | Dubbink et al. | 297/377 |
| 4,311,339 | 1/1982 | Heath | 297/487 |
| 4,338,691 | 7/1982 | Gaffney | 5/82 R |

FOREIGN PATENT DOCUMENTS

| | | | |
|---|---|---|---|
| 2086220 | 5/1982 | United Kingdom . | |
| 2111826 | 7/1983 | United Kingdom | 5/101 |

*Primary Examiner*—Alexander Grosz
*Assistant Examiner*—Michael F. Trettel
*Attorney, Agent, or Firm*—Victor Flores

[57] ABSTRACT

An infant carrier is improved with regards to comfort and transportability by utilizing, in combination, a plastic frame assembly and a laterally-resilient, mesh-type nylon material for supporting the infant. The plastic frame assembly is gently and downwardly contoured at the topmost and bottommost portions so as to provide a convenient and natural means of lifting the carrier. The mesh-type material is secured between an upper and lower plastic frame member. The plastic frame member is further provided with means of attaching a body harness and a tubular support stand.

6 Claims, 8 Drawing Figures

INFANT CARRIER

BACKGROUND OF THE INVENTION

1. Field of the Invention

The present invention generally relates to baby seats or infant carriers and more particularly, is concerned with improvements to infant carriers which greatly enhances the comfort of an infant and greatly enhances the portability of such devices.

2. Description of the Prior Art

Infant carriers are a common product used by parents to transport their infants from place to place and more particularly to lay the infants to rest, sleep, feed, or play. The period of time which the infant is confined to a carrier can vary from a few moments to a few hours depending upon the circumstances of portability. The comfort level during the time of confinement to a carrier depends to a large extent on the construction of the carrier, and more specifically to the infant supporting means employed in the construction of the carrier. Presently, the infant supporting means employed in infant carriers is typically an uncomfortable, solid seat back which is an integral part of the total carrier. Although attempts have been made to impart cushioning to the seat back, such efforts have not added to the the seat back of a carrier the type of resiliency required to give an infant the total comfort deserving during the confinement. Also, the portability of present carriers is generally very awkward due to the incorporating of supporting stand structure which will add features to allow attachment to some other object such as an adult chair or the back of a car seat, such structure will typically interfere with the natural manner in which a parent will carefully and lovingly pick up the infant and will generally add weight to the carrier or be of such lightweight construction as to be of questionable safety to the infant. Additionally, the carriers utilizing the awkward supporting stand structure are not suitably adapted to allow a parent to very caringly pick up the carrier with the infant.

Various types of infant carriers are known to attempt enhancement of comfort to infants confined to them. One such carrier is described and illustrated in U.S. Pat. No. 3,006,688 to A. J. Ouellette. The Ouellette patent discloses a baby seat wherein the infant supporting means is a one-piece body of flexible resilient sheet material suitably formed to provide the sides, bottom and seat back. The seat back has an offset central portion which is perforated and thus provides a cushioned back and results in overall reduction in weight. The offset portion may be contoured to accommodate an infant's body in attempt to add to the comfort of the infant seat. Similar cushioning is observed in U.S. Pat. No. 3,596,986 to L. B. Ragsdale wherein the inner shell member is a plastic material and has a back portion provided with a plurality of transverse ribs which serve as cushioning means for a baby. Other comfort enhancement are typically like those described and illustrated in U.S. Pat. No. 4,311,339 to R. B. Heath wherein an infant carrier has a seat back and seat portions lined with ribs and apertures of resilient energy absorbing material. Additionally, various types of infant carriers have improved on the portability. One such improvement is described in U.S. Pat. No. 3,272,556 to E. Rocker wherein the support stand is made adjustable to support the carrier in one of several open positions. The baby seat is suitably constructed to receive the adjustable support stand. Similar portability improvements are described in U.S. Pat. No. 3,858,936 to D. L. Gerken, wherein a wire support is selectively received in pluralities of sockets and clips on the back wall of the carrier to provide different angles of tilt.

However, although there have been efforts to improve on the comfort level of an infant while confined to an infant carrier, such efforts are believed to fall short of the type of comfort which an infant deserves while confined to such a device. The Ouellette, Ragsdale and the Heath patents have the disadvantage of not being able to engulf an infant in comfort due to the integral construction of the back portion with the other portions of the carrier. Another disadvantage is that the portability is not conducive to a gentle lifting of the carrier due to the interference of the supporting stand and or the associated structure which is molded to the main body of the carrier. The Rocker and the Gerken patents, while improving on the portability with respect to the angle of recline, fail to improve on that aspect of portability which would allow a parent to gently lift the carrier with the infant.

Consequently, a need exists for improvement in infant carriers which will result in an increased comfort with respect to the infant supporting means used and more particularly in improvements in infant supporting means which will provide comfort with regards to a resilient fit, body temperature and angle of recline. Additionally, a need exists to combine the comfort improvements with improvements of portability which will allow a parent to gently, lovingly, and caringly lift an infant laying in the carrier.

SUMMARY OF THE INVENTION

The present invention provides an infant carrier designed to satisfy the aforementioned needs. The infant carrier is constructed in an assembly manner such that the infant supporting means is not an integral part of the other portions of the assembly. Instead, a resilient, washable mesh-type material is securely disposed between upper and lower members of a molded frame assembly. Since the infant supporting means is not an integral part of the frame assembly, the problem of carriers having a generally stiff back portion due to one-piece construction techniques is eliminated. Additionally, the mesh-type material can be selected to provide the resilient fit required for comfort while allowing the frame assembly to be constructed of a sufficiently rigid material to impart overall stability to the carrier. Furthermore, the frame assembly can be contoured at opposed topmost and bottommost portions to provide a gentle, and caring means of lifting the carrier. Similarly, the frame assembly can be molded to provide an attaching means to attach a non-interfereing support stand at suitable angle of recline. Since the frame assembly is provided with suitably contoured lifting portions as well as with suitably designed attachment means for attaching a support stand, the problem of awkward portability is eliminated.

Accordingly, the present invention relates to infant carriers which are intended to be used to support an infant in a supine position, and which are improved with regards to comfort and portability by including: (a) a frame assembly, having opposed top and bottom portions contoured for gentle lifting, comprised of an upper frame member and a lower frame member suitably constructed for the attachment of an infant supporting means, a body harness and a non-interfereing support stand; and (b) means attached to the frame assembly for supporting an infant in a comfortable, supine position. The invention may also include a body harness for securing the infant to the carrier and further include a support stand constructed of lightweight, tubular material, which is attached to the frame assembly so as not to interfere with the gentle and caring lifting of the infant carrier.

DESCRIPTION OF THE PREFERRED EMBODIMENT

Figure 1:
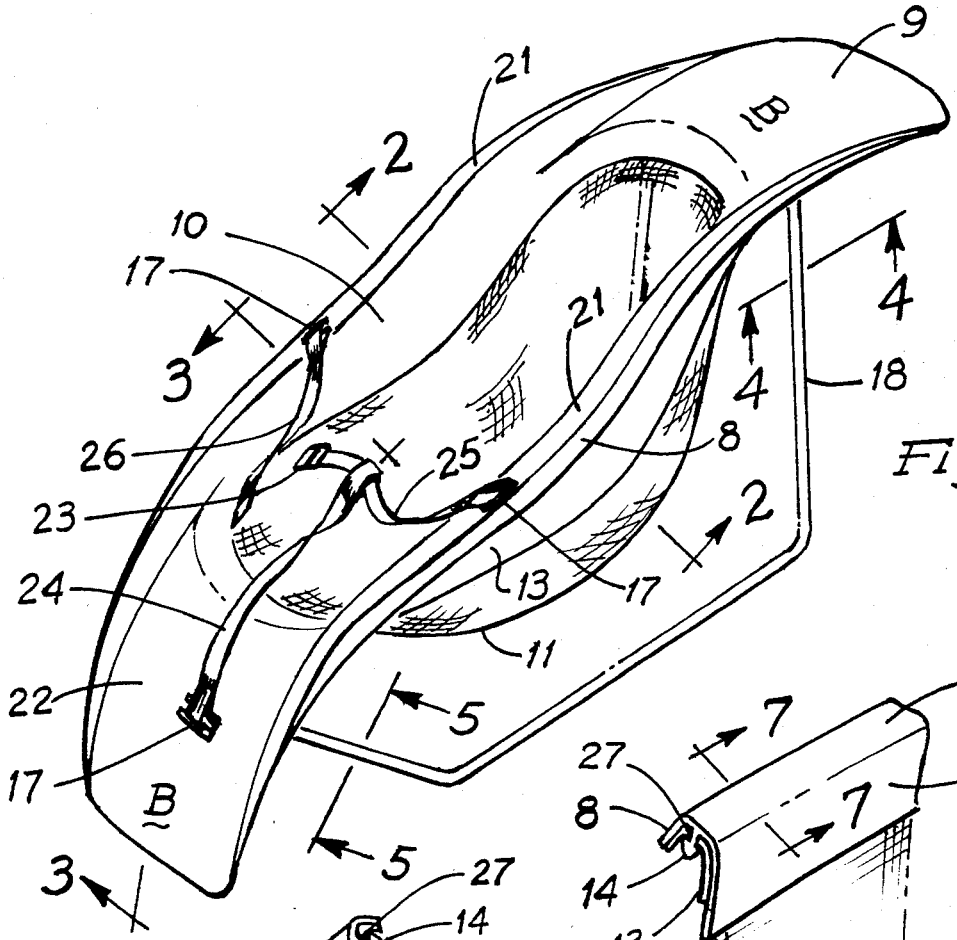
FIG. 1 is a perspective view of the present invention.

Referring now to the drawings, and more particularly to FIG. 1, there is shown the infant carrier generally as a plastic frame assembly B with a mesh-type infant supporting means 11 which comprises the preferred embodiment of the invention. The infant carrier includes the frame assembly B having upper frame member 33, lower frame member 13, mesh-type material 11 disposed therebetween, body harness having crotch strap 24 and waist straps 25 and 26, and tubular support stand 18.

Figure 2:
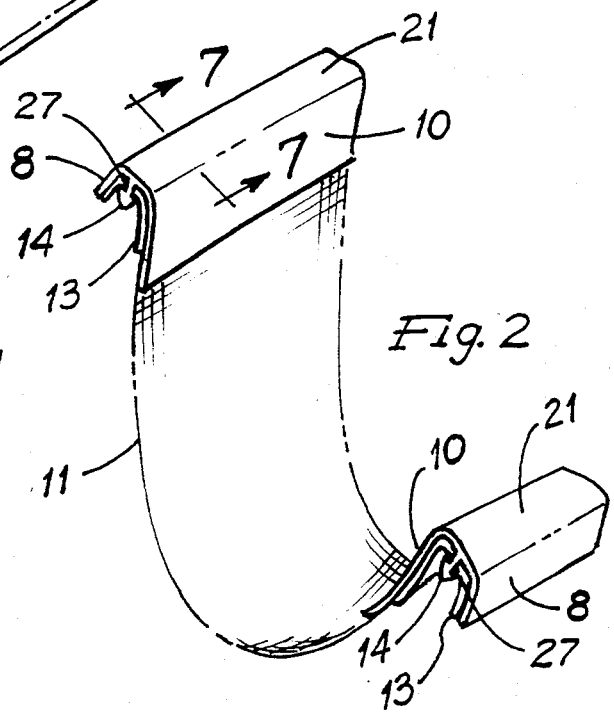
FIG. 2 is a midpoint cross-sectional view taken through 2—2 of FIG. 1.
Figure 3:
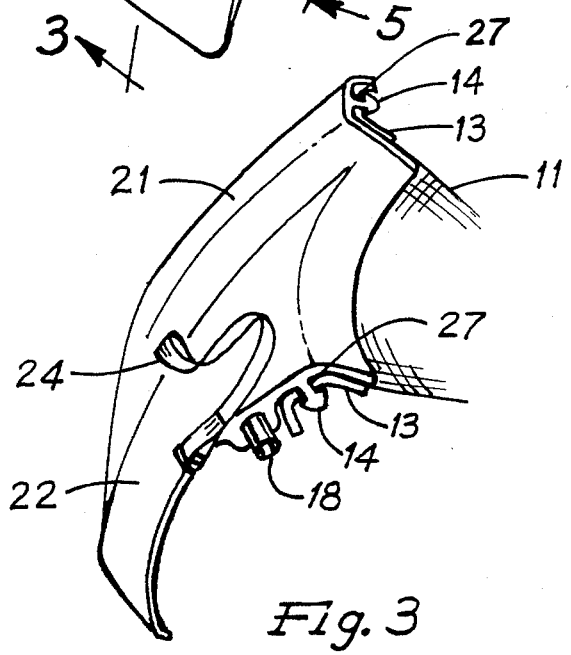
FIG. 3 is a quarter sectional-view of the lower portion of the present invention taken through 3—3 of FIG. 1.
Figure 4:
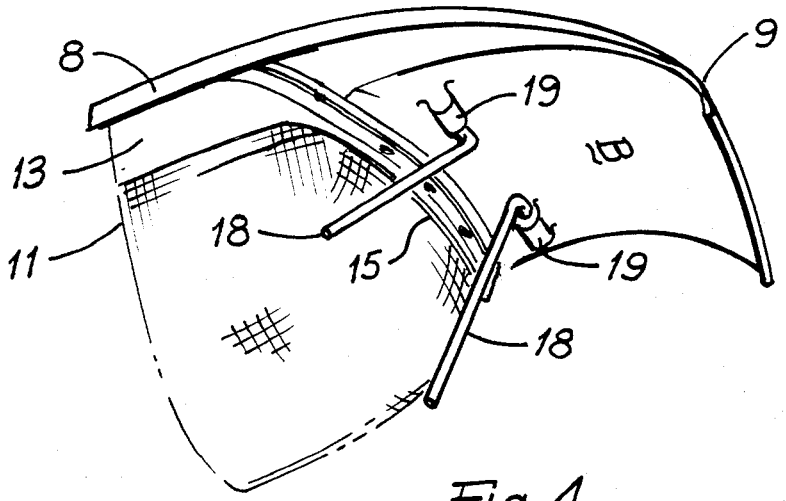
FIG. 4 is a fragmentary bottom view showing not only the tubular support stand's ends mounting configuration, but also the lower frame member attached to the upper frame member taken through 4—4 of FIG. 1.
Figure 5:
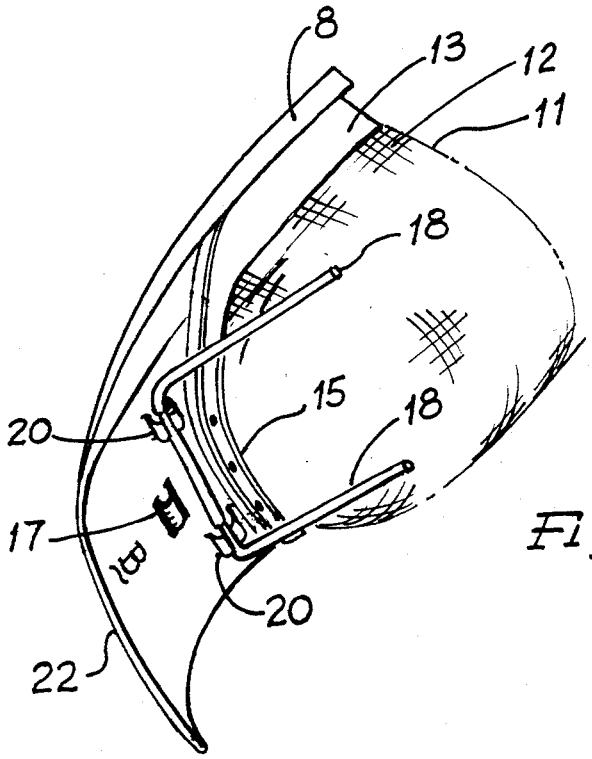
FIG. 5 is a fragmentary bottom view showing not only the mounting of the cross-member of the tubular support stand to molded rearwardly projecting clips, but also showing the lower frame member attached to the upper frame member taken through 5—5 of FIG. 1.
Figure 6:
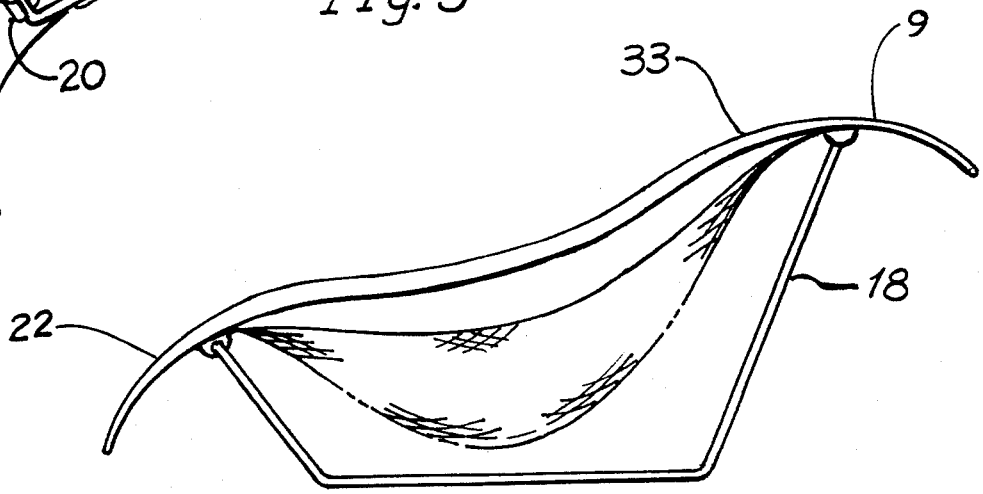
FIG. 6 is a profile view of the present invention in a horizontal position.
Figure 7:
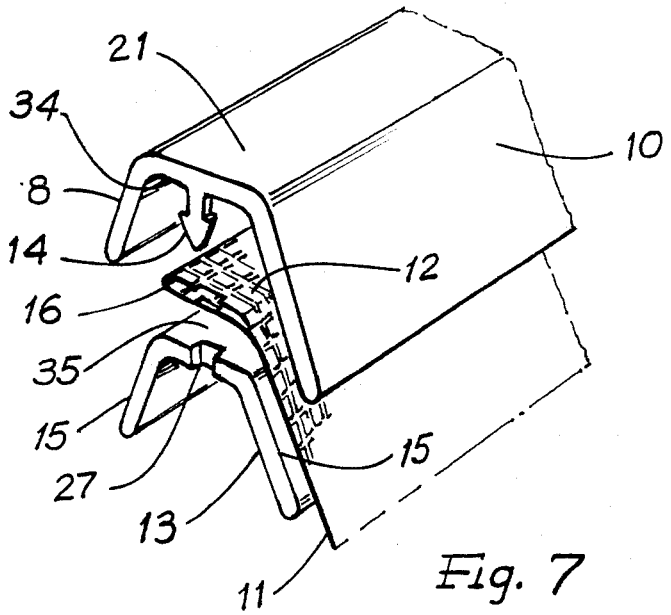
FIG. 7 is an enlarged fragmentary view showing points of attachment between upper and lower frame members of the frame assembly as well as the clamping means of attaching the mesh-type material between the upper and lower frame members taken through 7—7 of FIG. 2.
Figure 8:
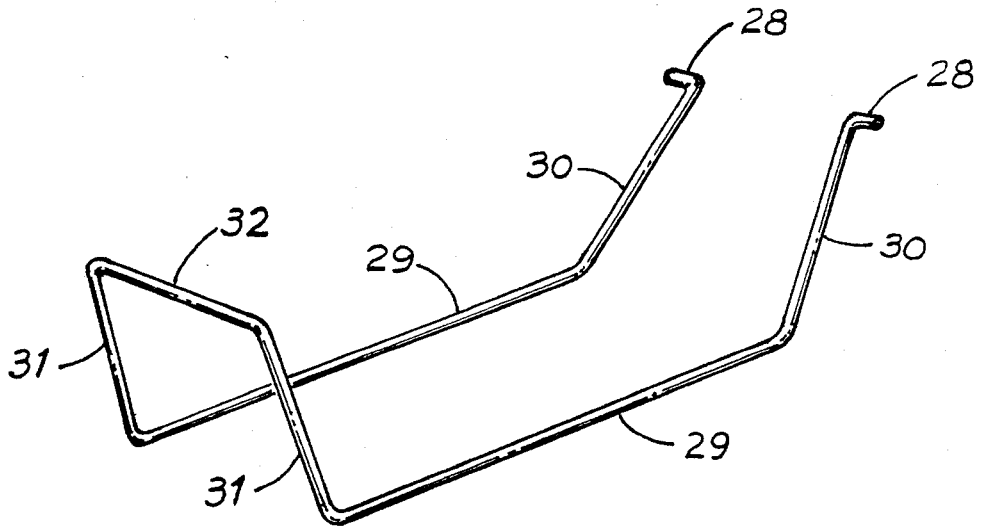
FIG. 8 is a perspective view of the tubular support stand showing the various portions which communicate with the frame assembly.

In the preferred embodiment of the infant carrier shown in FIG. 1, the frame assembly B is comprised of upper frame member 33 which includes an inner side wall 10 extending continuously along the inner periphery of the upper frame member 33. A pair of marginal flanges 8 are formed along opposed outer lateral sides of the upper frame member 33. The upper frame member 33 is molded to provide opposed lateral top surfaces 21 to blend with the inner side wall 10, marginal flanges 8, topmost portion 9 and bottommost portion 22. The upper frame member 33 is molded to provide a complement of slots 17 for attaching a body harness comprised of a crotch strap 24, a waist strap 25 with buckle 23, and a similar waist strap 26 without buckle 23. The complement of slots 17 are suitably located on opposed sides of top lateral surfaces 21 and on bottommost portion 22. As best seen in FIGS. 2, 3 and 7, a plurality of male locking pins 14 are suitably located and spaced on the undermost part 34 of the upper frame member 33 beneath top lateral surfaces 21, beneath topmost portion 9 and beneath bottommost portion 22. Male locking pins 14 will provide a means for attaching to lower frame member 13 and securing therebetween an infant supporting means 11. Also, as can best be seen from FIG. 4, the upper frame member 33 is further molded to provide a pair of rearwardly projecting sockets 19, horizontally and laterally spaced on the backside of the topmost portion 9, to provide a means of attachment of the ends 28 of tubular support stand 18. Additionally, as can best be seen in FIG. 5, a pair of rearwardly projecting clips 20, horizontally spaced on the backside of the bottommost portion 22, to provide a means of attaching a crossbar portion 32 of tubular support stand 18. Lastly, as can best be seen in FIG. 6, the upper frame member 33 is suitably contoured at opposed topmost portion 9 and bottommost portion 22 to provide a means of gently transporting the infant carrier by utilization of an adult's wrists and forearms.

Also, as best seen in FIGS. 2, 3, 4, 5 and 7, the frame assembly B is further comprised of lower frame member 13 suitably molded with side flanges 15 and top surface 35 for complementary attachment to the underside of upper frame member 33 beneath the periphery of inner side wall 10, beneath opposed lateral marginal flanges 8 and beneath opposed lateral top surfaces 21. Additionally, lower frame member 13 is suitably molded to provide a plurality of female receptors 27 so as to provide a means to complement and receive the plurality of male locking pins 14 on the upper frame member 33. The female receptors 27 will overlay the mesh-type material's hole pattern 12 to provide a rigid attachment of the lower frame member 13 and upper frame member 33 and an infant supporting means 11 disposed therebetween. Also, lower frame member 13 is suitably molded to provide slots 17 for attachment of waist harness straps 25 and 26, suitably located on opposed lateral top surfaces 35.

In the preferred embodiment of the invention, the frame assembly B is adapted to secure between upper frame member 33 and lower frame member 13, a laterally-resilient, mesh-type, nylon material 11 to provide a means for support of an infant in a supine position. The mesh-type material 11 is provided with a hemmed border 16 for providing a suitable peripheral attachment when mesh 11 is clamped between frame members 13 and 33. The mesh-type material 11 is additionally provided with a suitably sized hole pattern 12 for passively receiving the plurality of male locking pins 14 on upper frame member 33 and allowing attachment of pins 14 to receptors 27 on lower frame member 13.

The infant carrier as described in the foregoing paragraphs, is further provided with a lightweight, tubular support stand 18 and will rest on parallel horizontal tubular portions 29, and generally be reclined at about 30 degrees to the horizontal depending upon the bend provided for the opposed lower extention arms 31 and opposed upper extention arms 30. Upper extention arms 30 are bent inwardly to provide sufficient tension for rigid attachment of outwardly projecting end portions 28 to sockets 19 which are rearwardly projecting on upper frame member 33. By design, the attachment of tubular frame 18 to upper frame 33 will not interfere with transporting of the infant carrier by means of the contoured topmost portions 9, and bottommost portions 22.

It is thought that the infant carrier of the present invention will be understood from the foregoing description and it will be apparent that various changes can be made in form, construction and arrangement of the parts thereof without departing from the spirit and scope of the invention or sacrificing all of its material advantages, the form hereinbefore described being merely a preferred or exemplary embodiment thereof.

We claim:

1. An infant carrier, comprising:

a frame assembly comprised of an upper frame member and a lower frame member, said assembly being suitably constructed for the attachment of an infant supporting means, a body harness and a support stand; and means attached between said upper frame member and said lower frame member for supporting an infant in a supine position; and said upper frame member is suitably contoured at opposed topmost and bottommost portions to facilitate said infant carrier being transported by the utilization of an adult's wrists and forearms, wherein said upper frame member includes:

an inner side wall extending continously along the inner periphery; and a pair of marginal flanges formed along opposed outer lateral sides; and opposed lateral top surfaces suitably molded so as to blend with said inner side wall, said marginal flanges and said topmost and bottommost portions; and a complement of slots adapted for attaching a body harness and suitably located on opposed sides of said top lateral surfaces and on said bottommost portion; and a plurality of male locking pins suitably located and spaced on the undermost part beneath said top lateral surfaces and beneath said topmost and bottommost portions, whereby said male locking pins will provide a means for attaching to said lower frame member and securing an infant supporting means therebetween; and a pair of rearwardly projecting sockets horizontally and laterally spaced on the backside of the topmost portion and suitably on said backside so as to provide a means of attachment of the ends of a tubular support stand; and a pair of rearway projections clips horizontally and laterally spaced on the backside of the bottommost portion and suitably located on said backside so as to provide a means of attaching a crossbar portion of a tubular support stand, said clips and said sockets are suitably located so as not to cause a tubular support stand to interfere with transporting said infant carrier by means of said contoured topmost and bottommost portions.

2. An infant carrier as recited in claim 1, wherein said lower frame member includes:

suitably molded flanges for complementary attachment to the underside of said upper frame member to the areas beneath the periphery of said inner side wall, beneath said opposed lateral marginal flanges and beneath said opposed lateral top surfaces; and a plurality of female receptors suitably molded so as to complement and receive said plurality of male locking pins on said upper frame member, whereby the joining of said male locking pins and said female receptors provides a rigid attachment of said upper and lower frame members and an infant supporting means therebetween; and a complement of slots adapted for attaching a body harness and suitably located on opposed lateral sides so as to underlay similar slots on opposed lateral top surfaces of said upper frame member.

3. An infant carrier as recited in claim 1 or 2, wherein:

said means for supporting an infant in a supine position is a laterally-resilient, mesh-type, nylon material suitably disposed and securely attached between said upper and lower frame members; and said mesh-type material having a hemmed border adapted for providing a suitable peripheral attachment when clamped between said upper and lower frame members; and said mesh-type material has a suitably sized hole pattern for receiving said plurality of male locking pins on said upper frame member.

4. An infant carrier as recited in claim 1, further comprising:

(c) a body harness, said harness having a crotch strap member with a looped end, a first waist strap member with a buckle and encircled by said looped end of said crotch strap member, a second waist strap member without a buckle for attaching to said buckel on first waist strap member, said harness being adapted for attachment to suitably provided complement of slots on said upper and lower frame members.

5. An infant carrier as recited in claim 4, further comprising:

(d) a single piece tubular support stand adapted for attachment to the underside of said upper frame member and also adapted for positioning of said infant carrier in a reclined position, said stand having parallel horizontal portions, opposed upper and lower extention arms suitably bent such that said infant carrier is in a reclined position at about 30 degrees to the horizontal, a crossbar portion for attachment to said rearwardly projecting clips on said upper frame member, outwardly projecting end portions, said upper extention arms suitably bent inwardly to provide sufficient tension for rigid attachment of said outwardly projecting end portions to said rearwardly projecting sockets on said upper frame member.

6. An infant carrier, comprising:

(a) a plastic frame assembly including an upper frame member, said upper frame member having a topmost portion and a bottommost portion suitably contoured so as to facilitate said infant carrier being transported by the utilization of an adult's wrists and forearms, an inner side wall extending continuously along the inner periphery, a pair of marginal flanges formed along opposed outer lateral sides, opposed lateral top surfaces suitably molded so as to blend with said inner side wall, said marginal flanges and said topmost and bottommost portions, a complement of slots adapted for attaching a body harness and suitably located on opposed sides of said top lateral surfaces and on said bottommost portion, a plurality of male locking pins suitably located and spaced on the undermost part beneath said top lateral surfaces and beneath said topmost and bottommost portions, whereby said male locking pins will provide a means for attaching to said lower frame member and securing an infant supporting means therebetween, a pair of rearwardly projecting sockets horizontally and laterally spaced on the backside of the topmost portion and suitably located on said backside so as to provide a means of attachment of the ends of a tubular support stand, a pair of rearwardly projecting clips horizontally and laterally spaced on the backside of the bottommost portion and suitably located on said backside so as to provide a means of attaching a crossbar portion of said tubular support stand, said clips and said sockets are suitably located so as not to cause said tubular support stand to interfere with transporting said infant carrier by means of the said contoured topmost and bottommost portion; and (b) a plastic frame assembly including a lower frame member, said lower frame member having suitably molded flanges for complementary attachment to the underside of said upper frame member in the areas beneath the periphery of said inner side wall, beneath said opposed lateral marginal flanges and beneath said opposed lateral top surfaces, a plurality of female receptors suitably molded so as to complement and receive said plurality of male locking pins on said upper frame member, whereby the joining of said male locking pins and said female receptors provides a rigid attachment of said upper and lower frame members and an infant supporting means therebetween, a complement of slots adapted for attaching a body harness and suitably located on opposed lateral sides so as to underlay similar slots on opposed lateral top surfaces of said upper frame member; and (c) a laterally-resilient, mesh-type, nylon material suitably disposed and securely attached between said upper and lower frame members for supporting an infant in a supine position, said mesh-type material having a hemmed border adapted for providing a suitable peripheral attachment when clamped between said upper and lower frame members, a suitably sized hole pattern for receiving said plurality of male locking pins on said upper frame member; and (d) a body harness, said harness having a crotch strap member with a looped end, a first waist strap member with a buckle and encircled by said looped end of said crotch strap member, a second waist strap member without a buckle for attaching to said buckel on first waist strap member, said harness being adapted for attachment to suitably provided complement of slots on said upper and lower frame members; and.

(e) a single piece tubular support stand adapted for attachment to the underside of said upper frame member and also adapted for positioning of said infant carrier in a reclined position, said stand having parallel horizontal portions, opposed upper and lower extention arms suitably bent such that said infant carrier is in a reclined position at about 30 degrees to the horizontal, a crossbar portion for attachment to said rearwardly projecting clips on said upper frame member, outwardly projecting end portions, said upper extension arms suitably bent inwardly to provide sufficient tension for rigid attachment of said outwardly projecting end portions to said outwardly projecting sockets on said upper frame member.

* * * * *